US006679739B2

(12) United States Patent
Fujita

(10) Patent No.: US 6,679,739 B2
(45) Date of Patent: Jan. 20, 2004

(54) TERMINAL FITTING, A CONNECTOR PROVIDED THEREWITH AND USE THEREOF

(75) Inventor: Shinya Fujita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/179,357

(22) Filed: Jun. 24, 2002

(65) Prior Publication Data

US 2002/0197916 A1 Dec. 26, 2002

(30) Foreign Application Priority Data

Jun. 25, 2001 (JP) ..... 2001-191581

(51) Int. Cl.[7] ..... H01R 24/00
(52) U.S. Cl. ..... 439/862; 439/637
(58) Field of Search ..... 439/862, 637, 439/852, 853–854, 851

(56) References Cited

U.S. PATENT DOCUMENTS 3,742,430 A * 6/1973 Cairns ..... 439/862
5,083,936 A * 1/1992 Yang ..... 439/852
5,090,925 A * 2/1992 Sato et al. ..... 439/862
5,281,175 A * 1/1994 Chupak et al. ..... 439/852
5,660,569 A * 8/1997 Yamada et al. ..... 439/862
5,775,950 A * 7/1998 Tsuji ..... 439/637
6,024,612 A * 2/2000 Myer et al. ..... 439/852

FOREIGN PATENT DOCUMENTS

JP 2-16541 5/1990

* cited by examiner

*Primary Examiner*—P. Austin Bradley
*Assistant Examiner*—Felix O. Figueroa
(74) *Attorney, Agent, or Firm*—Gerald E. Hespos; Anthony J. Casella

(57) ABSTRACT

A terminal fitting (T) has a base wall (13) and side walls (16L, 16R) that extend from opposite sides of the base wall (13). A resilient contact piece (15) projects up and back from a front end of the base wall (13) and between the side walls (16L, 16R). A lean-preventing plate (20) extends from the first side wall (16L) and contacts the inner surface of the second side wall (16R) at a location obliquely forward of and above the front end of the resilient contact piece (15) to prevent the side walls (16L, 16R) from leaning.

12 Claims, 6 Drawing Sheets

TERMINAL FITTING, A CONNECTOR PROVIDED THEREWITH AND USE THEREOF

BACKGROUND OF THE INVENTION

Field of the Invention

The invention relates to a terminal fitting with a resilient contact piece that projects between side walls, to a connector provided with such a terminal fitting, and to a use of the connector.

DESCRIPTION OF THE RELATED ART

Japanese Unexamined Utility Model Publication No. 62-120287 discloses a terminal fitting for a circuit board. The terminal fitting has a bottom wall and left and right side walls that extend from opposite edges of the bottom wall. A resilient contact piece extends from a front end of the bottom wall and is folded between the side walls. The contact piece projects up more than the opposite side walls for connection with the circuit board.

Some terminal fittings have a resilient contact piece accommodated in a rectangular tube. A tab of a mating terminal is inserted into the rectangular tube for connection with the resilient contact piece. Two upper walls extend from the upper edges of the opposite side walls of the rectangular tube over substantially the entire length of the side walls. Thus, there is no possibility that the side walls will be deformed to lean transversely.

Terminal fittings with a resilient contact piece that projects up more than the side walls have had no upper wall because the resilient contact piece is between the upper edges of the side walls. Thus, the side walls may lean inwardly and interfere with the resilient contact piece. As a result, resilient deformation of the resilient contact piece is hindered and a connection error between the terminal fitting and the circuit board may occur.

The invention was developed in view of the above problem and an object thereof is to provide a terminal fitting in which a resilient contact piece projects between opposite side walls of the terminal fitting and where the side walls are prevented from leaning in.

SUMMARY OF THE INVENTION

The invention is directed to a terminal fitting with a base wall and first and second side walls that project from the base wall. A resilient contact piece extends obliquely up and back from a mating end of the base wall. A contact portion of the resilient contact piece is configured for contacting a mating contact and projects from the base wall a distance greater than the projection of the side walls. The resilient contact piece is resiliently deformable obliquely toward the base wall and away from the mating side. At least one side wall has a lean-preventing portion that extends between the side walls and into an area located further from the base wall than a resilient deformation area of the resilient contact piece and toward the mating side. An extending end of the lean preventing portion faces the inner surface of the opposed side wall.

When an external force acts on the side wall in a direction to lean the side wall inwardly, the extending end of the lean-preventing portion and the inner surface of the opposite side wall engage to prevent the side wall from leaning inwardly. The lean-preventing portion extends into an area further from the base wall and closer to the mating side than the resilient deformation area of the resilient contact piece. Thus, the lean preventing portion does not interfere with the resilient contact piece.

The lean-preventing portion preferably is near the mating end of the side wall.

At least one side wall may have a protecting portion that extends in from the mating end of the side wall to face a bent portion at the mating end of the resilient contact piece. An upper edge of the protecting portion and a bottom surface of the lean-preventing portion preferably are in contact or are proximate to each other. Thus, external matter that may approach the front end of the resilient contact piece from the front will strike against the protecting portion and will not interfere with the bent portion at the front end of the resilient contact piece. Further, an external force that acts down on the lean-preventing portion urges the lean-preventing portion into contact with the upper edge of the protecting portion. As a result, the lean-preventing portion will not deform downwardly and the side wall will not lean inwardly.

A support preferably extends from the side wall opposite the side wall from which the lean-preventing portion extends and substantially contacts an upper surface of the lean-preventing portion. The support may receive downward forces that could otherwise deform the lean-preventing portion.

An error insertion preventing portion may extend from a side wall of the terminal fitting, and interferes with an opening edge of a cavity in a housing when the terminal fitting is inserted into the cavity in an improper orientation. The error insertion preventing portion preferably is on the support, and therefore is before the resilient contact piece. As a result, the resilient contact piece will not interfere with the opening edge of the cavity.

The invention also is directed to a connector with a housing that has cavities preferably arrayed substantially side by side. According to a preferred embodiment, the cavities are arranged at two stages. The above-described terminal fittings are inserted into the cavities.

The invention also is directed to a use of the above-described connector as a card edge connector, wherein the contact mate is a connection portion of a circuit board.

These and other features and advantages of the invention will become more apparent upon reading of the following detailed description and accompanying drawings. Even though embodiments are described separately, single features may be combined to additional embodiments.

DETAILED DESCRIPTION OF THE PREFERRED EMBODIMENTS

A terminal fitting and a connector according to the invention are described with reference to FIGS. 1 to 6. In the following description, a mating end of a connector 30 and/or of a terminal fitting T with a mating connector 40 is referred to as the front.

Figure 4:
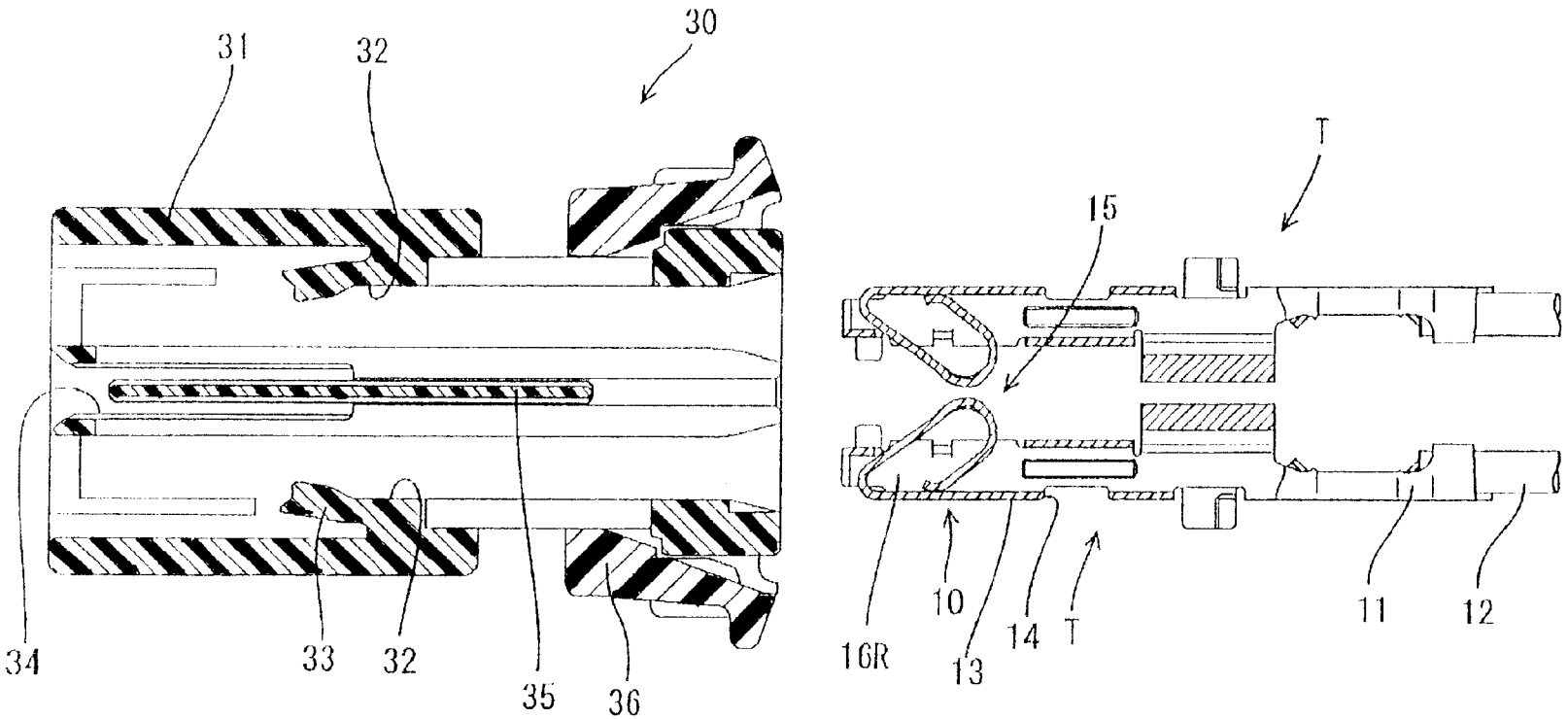
FIG. 4 is a section showing terminal fittings are withdrawn from a housing.
Figure 5:
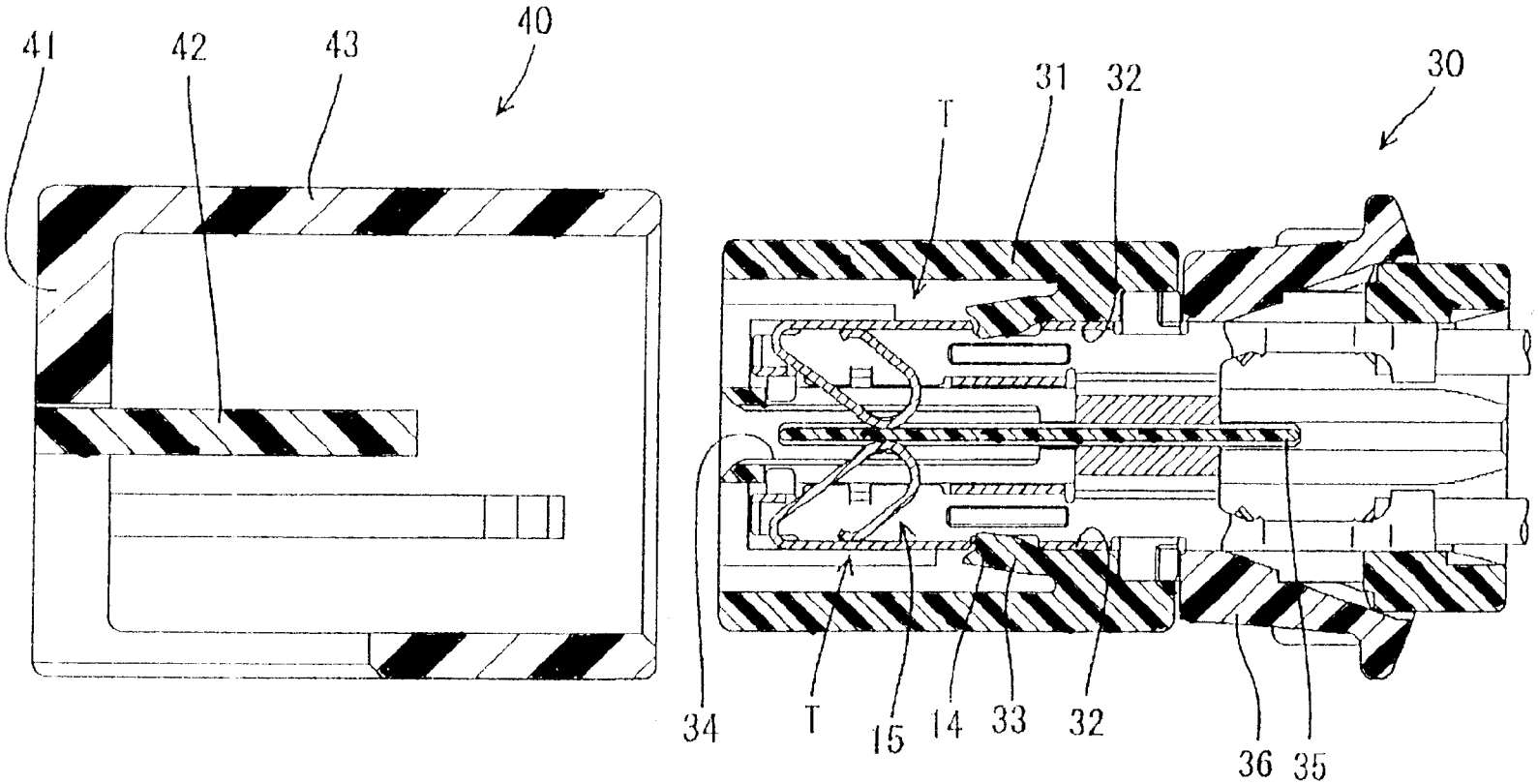
FIG. 5 is a section showing a state where the housing having the terminal fittings inserted thereinto and a mating connector are separated.
Figure 6:
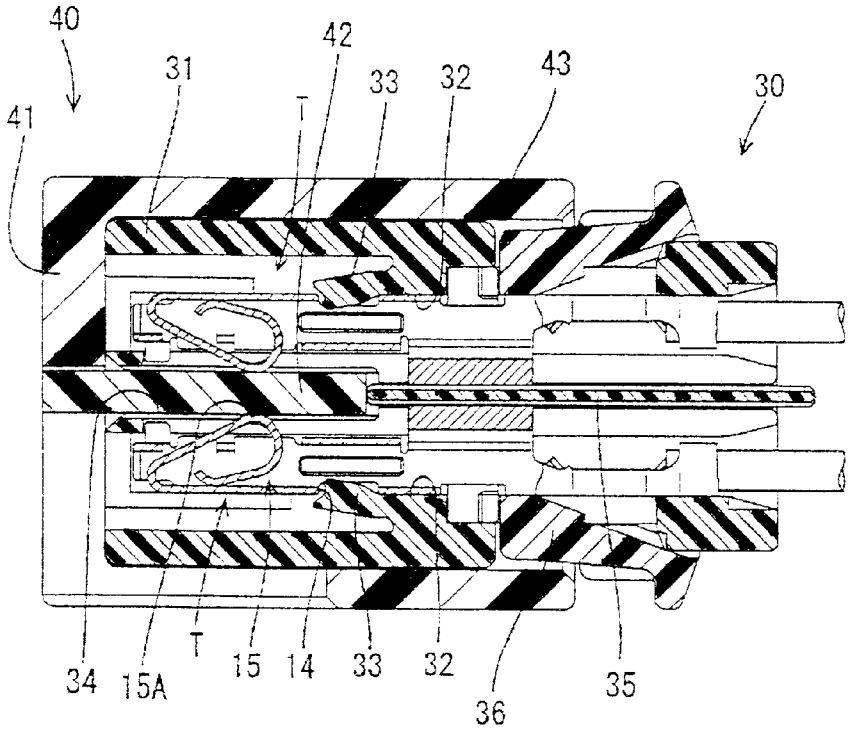
FIG. 6 is a section showing the housing having the terminal fittings inserted therein and the mating connector are connected with each other.

A terminal fitting T of this embodiment is mountable into a card edge connector 30, and the card edge connector 30 is connectable with a mating connector 40. The card edge connector 30 has a housing 31 made e.g. of a synthetic resin, and upper and lower stages of side-by-side cavities 32 are open in the front and rear surfaces of the housing 31, as shown in FIGS. 4 to 6. A lock 33 is formed in each cavity 32 for locking the terminal fitting T inserted into the cavity 32 from behind. The cavities 32 and the locks 33 at the upper stage are substantially symmetrical with those at the lower stage with respect to a horizontal plane located between them. The housing 31 also has an insertion space 34 in the form of a wide slit that opens in the front end of the housing 31. The insertion space 34 is at a height between the cavities 32 of the upper and lower stages, and communicates with the cavities 32 at the upper and lower stages. A movable insulating plate 35 is provided between the cavities 32 at the upper stage and those at the lower stage for avoiding a short circuit between the terminal fittings T at the upper stage and those at the lower stage.

The mating connector 40 has a housing 41 made of a synthetic resin and a circuit board 42 mounted in the housing 41. An end portion (card edge) of the circuit board 42 projects forward toward a mating side and into a receptacle 43 of the housing 41, as shown e.g. in FIG. 5.

The terminal fitting T is narrow and long in forward and backward directions and is formed by bending, folding and/or embossing a metallic plate stamped or cut out into a specified shape. A front section of the terminal fitting T is formed into a connecting portion 10 for connection with the circuit board 42. A rear portion of the terminal fitting T is a wire crimping portion 11, and is configured to be crimped into connection with a wire 12.

The connecting portion 10 of the terminal fitting T that is insertable into the cavity 32 at the lower stage has a long narrow bottom wall 13 with a locking hole 14. A resilient contact piece 15 extends obliquely up away from the bottom wall 13 and back away from the front end at an acute angle to the bottom wall 13. Left and right side walls 16L, 16R stand up substantially at right angles from the opposite lateral edges of the bottom wall 13.

The resilient contact piece 15 is substantially U-shaped, and has a substantially U-shaped curved contact portion 15A that projects up beyond the upper edges of the side walls 16L, 16R in a free unbiased state of the resilient contact piece 15. Thus, the contact portion 15A is at a distance from the bottom wall 13 that exceeds a projecting distance of the side walls 16 from the bottom wall 13 when the contact piece 15 is not deformed. An extending end 15B of an obliquely forward extending section of the substantially U-shaped portion of the resilient contact piece 15 contacts the upper surface of the bottom wall 13. The contact portion 15A can be brought resiliently into contact with the lower surface of the circuit board 42. As a result, the contact piece 15 is deformed resiliently in a direction DD obliquely down and back, away from the mating end and towards the bottom wall 13, substantially about a bent portion 15C at its front end. Therefore, the resilient contact piece 15 can be deformed such that the contact portion 15A moves towards the bottom wall 13 while being deformed about the bent portion 15C that connects the resilient contact piece 15 with the bottom wall 13 at the front end of the terminal fitting T.

Figure 1:
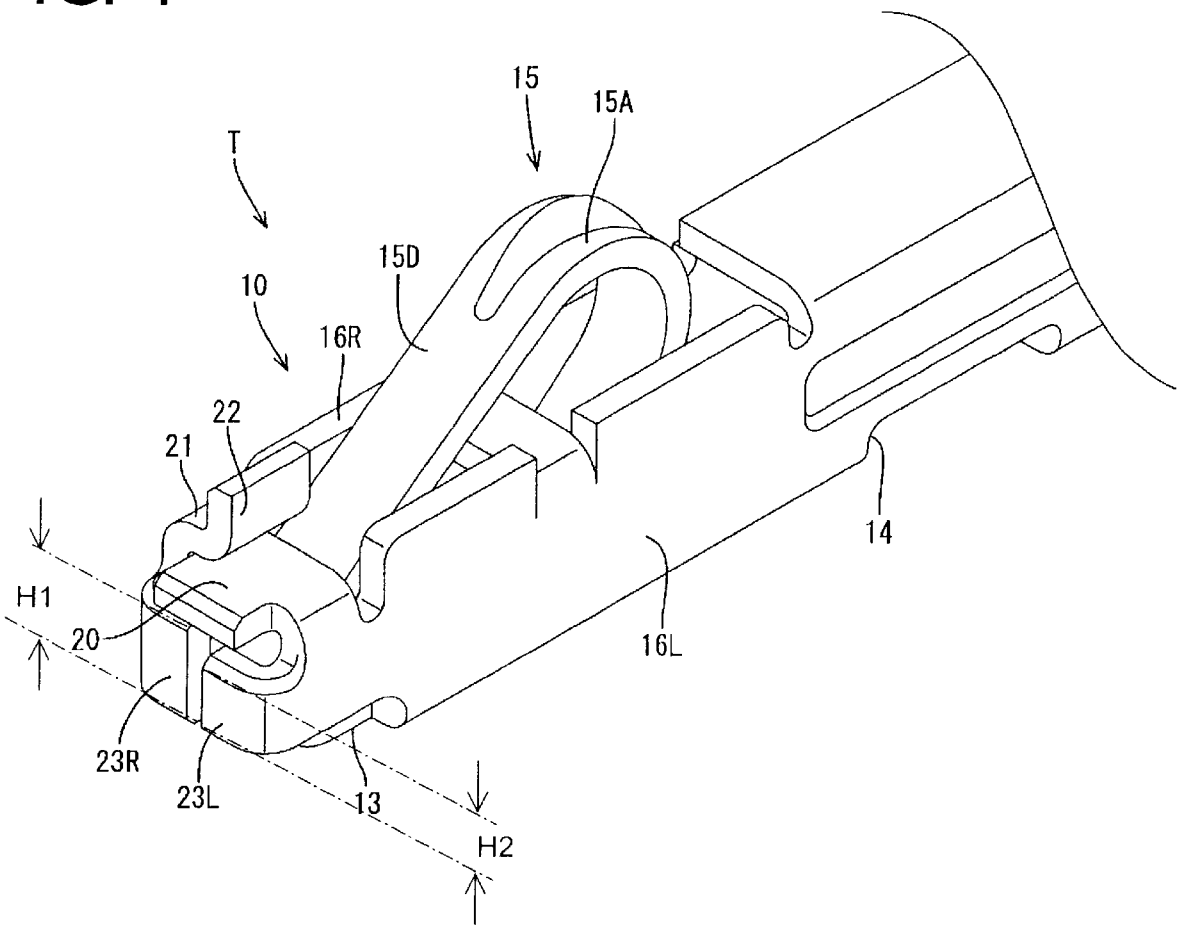
FIG. 1 is a perspective view of a terminal fitting according to one embodiment of the invention.
Figure 2:
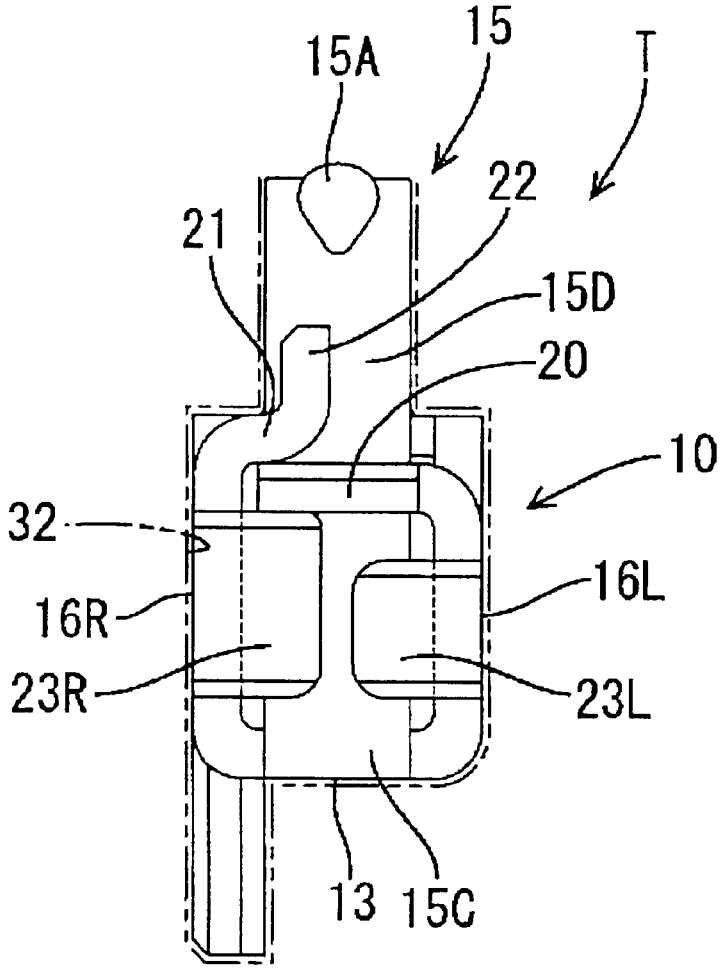
FIG. 2 is a front view of the terminal fitting.
Figure 3:
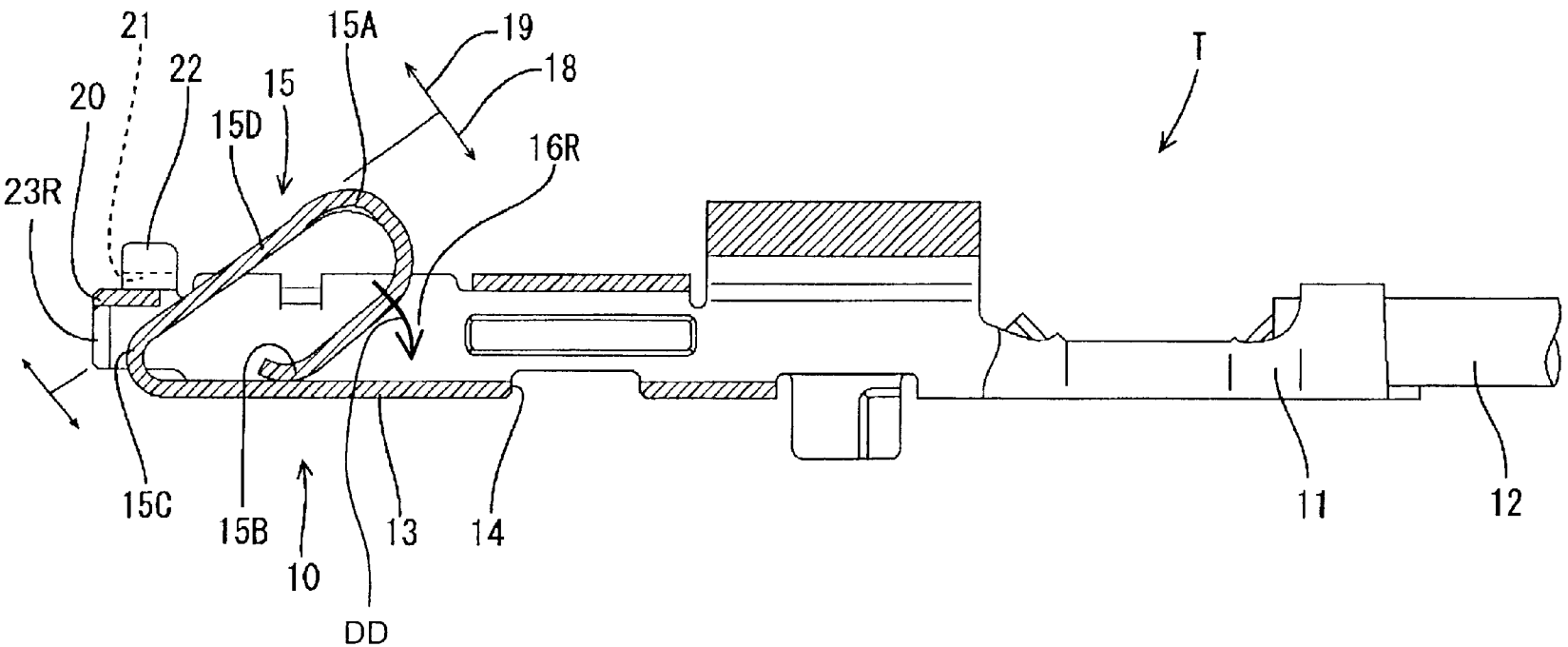
FIG. 3 is a side view partly in section of the terminal fitting.

With reference to FIG. 3, a resilient deformation area 18 of the resilient contact piece 15 is defined obliquely below and back from the oblique front upper surface of a substantially planar inclined portion 15D that extends obliquely up and back from the bent portion 15C at the front end of the resilient contact piece 15. An area 19 is located obliquely up and in front of the inclined portion 15D, and hence is obliquely above and in front of the resilient deformation area 18 of the resilient contact piece 15.

A lean-preventing plate 20 extends from the upper front edge of the left side wall 16L into the above-described area 19 that is obliquely above and in front of a resilient deformation area 18 of the resilient contact piece 15. Hence, the lean-preventing plate 20 is above the bent portion 15C. The lean-preventing plate 20 extends between the opposite side walls 16L and 16R, and an extending end of the lean-preventing plate 20 faces the upper end of the inner surface of the right side wall 16R while defining a very small clearance therebetween. The lean-preventing plate 20 is at substantially right angles to the left side wall 16L, and is substantially parallel with the bottom wall 13.

A support 21 extends leftward from the upper front end of the right side wall 16R, and is placed on the upper surface of the lean-preventing plate 20. The support 21 overlaps the lean-preventing plate 20 only at the extending end of the lean-preventing plate 20 furthest from the left side wall 16L.

An error insertion preventing plate 22 extends up from the extending left end of the support 21. The error insertion preventing plate 22 overlaps the resilient contact piece 15 when viewed from front, and hence is aligned partly with the resilient contact piece 15.

A left protecting plate 23L extends inwardly (rightward) at substantially right angles from the front edge of the left side wall 16L. Similarly, a right protecting plate 23R extends inwardly (leftward) at substantially right angles from the front edge of the right side wall 16R. The height H1 of the upper edge of the right protecting plate 23R is higher than the height H2 of the left protecting plate 23L. The upper edge of the right protecting plate 23R substantially contacts the bottom surface of the front end of the lean-preventing plate 20 to support the lean-preventing plate 20 from below. The right protecting plate 23R also substantially contacts the right end of the lean-preventing plate 20 at the right extending end of the lean-preventing plate 20. Accordingly, the right end of the lean-preventing portion 20 is vertically held between the support 21 formed at the right side wall 16R and the right protecting plate 23R formed at the right side wall 16R. Although the upper edge of the right protecting plate 23R contacts the lower surface of the lean-preventing plate 20, a small clearance may be defined between the right protecting plate 23R and the lean-preventing plate 20.

The terminal fitting T inserted into the cavity 32 at the upper stage is the same as the terminal fitting T inserted into the cavity 32 at the lower stage, but is inverted in the cavity 32.

The terminal fitting T is inserted into the cavity 32 from behind the housing 31 while being connected with the wire 12. During the insertion of the terminal fitting T, the lock 33 interferes with the bottom wall 13 of the terminal fitting T, and is deformed and retracted from an insertion path (cavity 32) for the terminal fitting T. When the terminal fitting T reaches a proper insertion position, the lock 33 is restored resiliently and engages the locking hole 14 to hold the terminal fitting T, as shown in FIGS. 5 and 6. A retainer 36 assembled with the housing 31 also locks the terminal fitting T. With the terminal fittings T inserted into the housing 31, the contact portions 15A of the resilient contact pieces 15 of the respective terminal fittings T project from the left and right side walls 16L, 16R to enter the insertion space 34 and wait on standby until connected with the circuit board 42. The movable insulating plate 35 is located between the resilient contact pieces 15 at the upper and lower stages. In this way, the assembling of the card edge connector 30 is substantially completed.

The card edge connector 30 then is connected by being fit into the receptacle 43 of the mating connector 40. In a connected state, the end of the circuit board 42 enters the insertion space 34 of the housing 31 to force into between the resilient contact pieces 15 at the upper and lower stages, thereby resiliently deforming the resilient contact pieces 15 away from the insertion space 34. Thus, the resilient contact pieces 15 are held resiliently in contact with the upper and lower surfaces of the circuit board 42 at a specified contact pressure resulting from their resilient restoring forces and are connected with unillustrated circuits of the circuit board 42. The movable insulating plate 25 is moved by the circuit board 42 to a position more backward than the resilient contact pieces 15. In this way, the connection of the two connectors 30, 40 is completed.

When an external force acts on the left side wall 16L in a direction to lean the left side wall 16L inwardly (leftwardly), the extending end of the lean-preventing plate 20 formed at the left side wall 16L contacts the inner surface of the right side wall 16R to prevent the left side wall 16L from leaning. Further, when an external force acts on the right side wall 16R in a direction to lean the right side wall 16R inwardly (rightwardly), the inner surface of the right side wall 16R contacts the extending end of the lean-preventing plate 20 extending from the left side wall 16L, thereby preventing the right side wall 16R from leaning. The lean-preventing plate 20 extend into the area 19 obliquely above and to the front of the resilient deformation area 18 of the resilient contact piece 15 and between the opposite side walls 16L and 16R. Thus, the lean-preventing plate 20 does not interfere with the resilient contact piece 15 even if the resilient contact piece 15 undergoes a resilient deformation during the connection with the circuit board 42. In this way, a means for preventing the side walls 16L, 16R from leaning without interfering with the resilient contact piece 15 is realized by the lean-preventing plate 20.

External matter (not shown) could strike against the error insertion preventing plate 22 or the support 21 to exert a downward force on the lean-preventing plate 20. However, the lean-preventing plate 20 contacts the upper edge of the right protecting plate 23R to prevent a downward deformation of the lean-preventing plate 20. Particularly, since the contact area of the lean-preventing plate 20 with the right protecting plate 23R is supported by the left side wall 16L, the right protecting plate 23R is substantially free from deformation. Thus, an effect of preventing the deformation of the lean-preventing plate 20 is higher. Further, since the support 21 is on the upper surface of the lean-preventing plate 20, an external force acting from above is received by the rigidity of the support 21 itself, and downward deformation of the lean-preventing plate 20 is prevented. Since the downward deformation of the lean-preventing plate 20 is prevented in this way, the side walls 16L, 16R are prevented from leaning inwardly.

External matter (not shown) could approach the front end of the resilient contact piece 15. However, the external matter would strike against both or one of the protecting plates 23L, 23R and/or against the error insertion plate 22. Thus, the interference of the external matter with the bent portion 15C at the front end of the resilient contact piece 15 can be prevented.

An attempt could be made to insert the terminal fitting T into the cavity 32 with an improper orientation (e.g. upside down). However, the error insertion preventing plate 22 interferes with an opening edge of the cavity 32 to prevent the terminal fitting T from being inserted in an improper orientation. At this time, the lean-preventing plate 20, on which the support 21 of the error insertion preventing plate 22 is placed, is before the resilient contact piece 15, and the error insertion preventing plate 22 also is before the resilient contact piece 15. Therefore, there is no possibility that the resilient contact piece 15 interferes with the opening edge of the cavity 32.

The invention is not limited to the above described and illustrated embodiment. For example, the following embodiments are also embraced by the technical scope of the present invention as defined in the claims. Beside the following embodiments, various changes can be made without departing from the scope and spirit of the present invention as defined in the claims.

Although the lean-preventing plate is formed only at the left side wall in the foregoing embodiment, it may be formed only at the right side wall or may be formed at both side walls according to the present invention.

Although the lean-preventing plate is at the front end of the left side wall in the foregoing embodiment, it may be provided slightly back from the front end according to the present invention.

Only one of the protecting plates formed on the opposite side walls functions to prevent the downward displacement of the lean-preventing plate in the foregoing embodiment. However, both protecting plates or the other of two protecting plates may be provided with a downward displacement preventing function.

Although the protecting plates are formed at the opposite side walls in the foregoing embodiment, either one of the opposite side walls may be formed with the protecting portion, and the protecting plate may extend to the other side wall. In such a case, the protecting plate and the lean-preventing plate may be formed at the same side wall or may be formed at different side walls.

The support is placed on the upper surface of the lean-preventing plate and the error insertion preventing plate stands up from the support in the foregoing embodiment. However, only the support may be placed on the lean-preventing plate without forming the error insertion preventing portion. In this case as well, when a downward acting force is exerted on the support, part of the external force is received by the support to prevent the downward deformation of the lean-preventing plate.

Although the error insertion preventing plate stands up from the extending end of the support in the foregoing embodiment, it may stand up from the upper end of the side wall while being substantially in flush with this side wall.

What is claimed is:

1. A terminal fitting comprising a base wall, first and second opposite side walls projecting from the base wall, a resilient contact piece extending obliquely up and back from a mating end of the base wall, a contact portion of the resilient contact piece projecting from the base wall a distance greater than a projecting distance of the side walls from the base wall, the resilient contact piece being resiliently deformable in a direction obliquely toward the base wall and away from the mating end, the first side wall being formed with a lean-preventing plate extending into an area located obliquely further from the base wall and more toward the mating end than a resilient deformation area of the resilient contact piece between the opposite side walls, wherein at least one of the side walls is formed with a protecting plate that extends inwardly at a location between the mating end of the base wall and the resilient contact piece, the protecting plate having an upper edge that supports a surface of the lean-preventing plate facing the base wall.

2. The terminal fitting of claim 1, wherein an extending end of the lean-preventing plate faces an inner face of the second side wall.

3. The terminal fitting of claim 2, wherein the side walls stand up from the opposite lateral edges of the base wall.

4. The terminal fitting of claim 3, wherein the lean-preventing plate is at an end of the first side wall adjacent the mating end of the base wall.

5. The terminal fitting of claim 1, wherein a support extends from the second side wall and is on an upper surface of the lean-preventing plate.

6. The terminal fitting of claim 1, wherein the terminal fitting is inserted into a cavity in a housing, and an error insertion preventing plate is formed at one of said side walls so as to interfere with an opening edge of the cavity when the terminal fitting is inserted into the cavity in an improper orientation.

7. A terminal fitting comprising a base wall with opposite front and rear ends and first and second opposite side edges extending between the ends, first and second opposite side walls projecting selected projecting distances from the first and second side edges of the base wall, a resilient contact piece having a bent portion unitary with the front end of the base wall, the resilient contact piece extending obliquely up and back from the bent portion and between the side walls, a contact portion of the resilient contact piece being spaced from the base wall a distance greater than the selected projecting distances of the side walls, a lean-preventing plate extending from the first side wall to the second side wall at a location above the bent portion of the resilient contact piece, wherein at least one of the side walls is formed with a protecting plate that extends inwardly at a location between the mating end of the base wall and the resilient contact piece, the protecting plate having an upper edge that supports a surface of the lean-preventing plate facing the base wall.

8. The terminal fitting of claim 7, wherein an extending end of the lean-preventing plate faces an inner face of the second side wall.

9. The terminal fitting of claim 8, wherein the lean-preventing plate (20) is at an end of the first side wall (16L) adjacent the first end of the base wall (13).

10. The terminal fitting of claim 7, wherein a support extends from the second side wall and is disposed on a surface of the lean-preventing plate facing away from the base wall.

11. A connector comprising:

a housing (31) with cavities (32) arrayed substantially side by side, and terminal fittings inserted into the cavities, each said terminal fitting comprising a base wall, first and second opposite side walls projecting from the base wall, a resilient contact piece extending obliquely up and back from a mating end of the base wall, a contact portion of the resilient contact piece projecting from the base wall a distance greater than a projecting distance of the side walls from the base wall, the resilient contact piece being resiliently deformable in a direction (DO) obliquely toward the base wall and away from the mating end, the first side wall (16L) being formed with a lean-preventing plate extending into an area located obliquely further from the base wall and more toward the mating end than a resilient deformation area of the resilient contact piece between the opposite side walls, a support extending from the second sidewall and disposed on an upper surface of the lean preventing plate, an error insertion preventing plate extending up from the support at a location in front of the resilient contact piece for preventing insertion of the terminal fitting into the cavity in an improper orientation and for preventing inadvertent contact of external matter with the resilient contact.

12. The connector according to claim 11, wherein the cavities are arranged at two stages.

* * * * *